United States Patent [19]

Sawicki

[11] Patent Number: 4,624,378

[45] Date of Patent: Nov. 25, 1986

[54] TAMPER INDICATING COVER

[76] Inventor: Nina P. Sawicki, 8347 Ranchito Ave., Panorama City, Calif. 91402

[21] Appl. No.: 736,176

[22] Filed: May 20, 1985

Related U.S. Application Data

[63] Continuation-in-part of Ser. No. 467,103, Feb. 16, 1983, Pat. No. 4,534,478.

[51] Int. Cl.[4] ..... B65D 41/46

[52] U.S. Cl. ..... 215/230; 215/256

[58] Field of Search ..... 215/230, 251, 254, 255, 215/256, 257, 258

[56] References Cited

U.S. PATENT DOCUMENTS

| | | | |
|---|---|---|---|
| 3,080,991 | 3/1963 | Fox | 215/257 |
| 3,191,790 | 6/1965 | Cowen et al. | 215/251 |
| 3,901,403 | 8/1975 | Menke | 215/251 |
| 4,565,294 | 1/1986 | Smith | 215/251 |

FOREIGN PATENT DOCUMENTS

| | | | |
|---|---|---|---|
| 428469 | 7/1967 | Switzerland | 215/254 |
| 705816 | 3/1954 | United Kingdom | 215/257 |

*Primary Examiner*—Donald F. Norton

*Attorney, Agent, or Firm*—Nilsson, Robbins, Dalgarn, Berliner, Carson & Wurst

[57] ABSTRACT

A tamper indicating cover seals the closure of a cap container. The cover is secured to the container by means of a safety band secured over an annular protrusion on the container. The safety band has visual indicia different from the remainder of the cover so that when a pull tab on the safety band is pulled, the indicia controling safety band is removed. As the safety band is removed, the remainder of the plastic cover is torn as a result of a helical tear line which may be a stress pattern or a thread embedded in the plastic cover. The cover is secured to the container by heat fusing or other means between the safety band and the protrusion on the container.

20 Claims, 5 Drawing Figures

FIG. 1
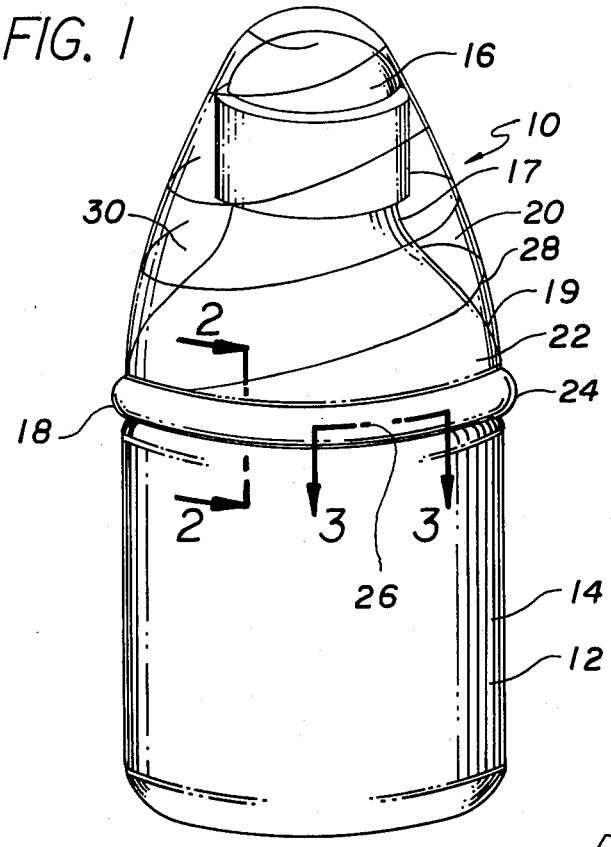
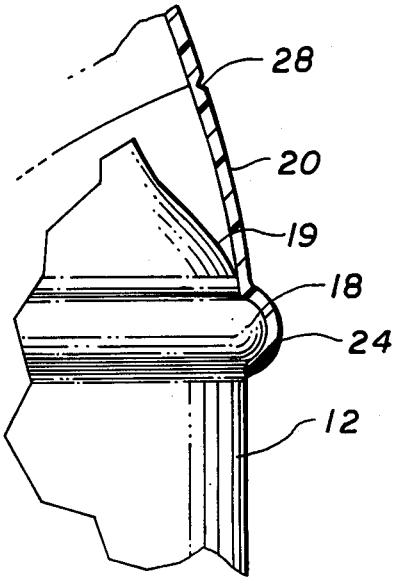
FIG. 2
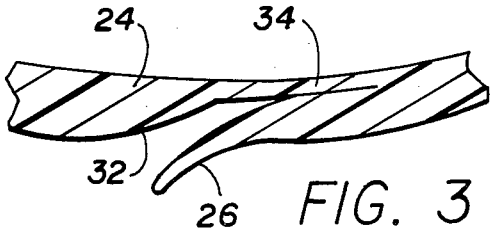
FIG. 3
FIG. 5
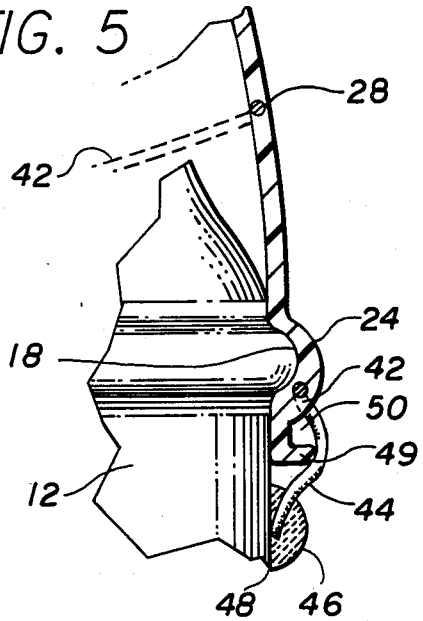
FIG. 4
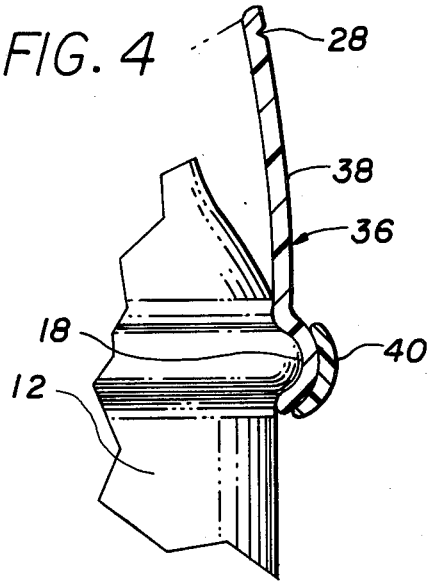

TAMPER INDICATING COVER

This is a continuation-in-part of U.S. patent application Ser. No. 467,103 filed, Feb. 16, 1983, now U.S. Pat. No. 4,534,478.

BACKGROUND OF THE INVENTION

The present invention relates to apparatus for indicating when a container has been tampered with and more particularly comprises a cover affixed to a container with a conventional cap on the closure end of the container.

Recent events have dramatically demonstrated the need for improved tamper resistant containers to prevent adulteration of the products in the containers. Heretofore, various closure devices have been developed which require the tearing of the cap placed on the container to effect opening of the container. Such closure apparatus are illustrated in Hutaff, U.S. Pat. No. 2,109,699; Langecker, U.S. Pat. No. 3,434,613; Faulstich, U.S. Pat. No. 3,392,860; Hermann, U.S. Pat. No. 834,906; Studer, U.S. Pat. No. 3,112,838; and Vido, United Kingdom Pat. No. 1,079,417. None of these references show a cover for placement over the top of a container already having a cap thereon so that the cover prevents access to the cap.

In Sakurai, U.S. Pat. No. 3,640,417, a heat shrinkable sleeve for closing a container is disclosed. However the sleeve is provided to be placed underneath the cap. Hence, it would be impossible for a consumer to readily observe whether the sleeve has been removed or is still in place without removing the cap from the container. Consequent, the consumer could purchase a container which had been tampered with and not know it.

By contrast, the present invention provides a cover which can be positioned over any of a number of different containers with conventional non-tamper proof caps thereon to effectively make the container tamper-proof. As such the manufacturers bottle retains its identity in the eyes of the consumer. This is particularly true when the cover is provided to be either translucent or transparent so that the cap and top of the container can be observed by the consumer through the tamper resistant cover.

More specifically, the present invention includes a cover which may be either a dome shape shroud member or a heat-shrink shroud member which covers the top of a container including the conventional cap closing container. At the lower edge of the shroud portion of the cover, a safety band which is a thickened annular portion made out of the same material as the upper shroud portion is provided to extend over the annular protrusion located on the container. The safety band is made of a different color or has printings and markings on it that define indicia that do not appear on the shroud portion of the cover so that when the safety band is removed, a consumer will realize by merely observing the container.

Indeed, in order to remove the cover, a consumer must focus his attention on the safety band to effect removal of the band. Since any tampering with the cover of the present invention would result in damage to that very safety band, the consumers' attention will focus on the very item that must be effected by tampering. Hence, the consumer will be more likely to notice tampering.

The cover, in accordance with the invention, includes a pull tab which is cut into the safety band. When the pull tab is pulled, the safety band tears in such a way as to cause the cover itself to also tear along annular lines defined in the shroud portion. These tear lines may either have a circular or helical configuration. In accordance with the invention, the safety band is heat bonded or adhesively bonded to the container so that the cover cannot be removed without tearing the safety band and hence the shroud. In another form of the invention, the safety band is made out of the same material as the upper shroud portion, however the band is affixed to the shroud portion by heat bonding or adhesively bonding the safety bond to the shroud. Therefore, once the pull tab has been pulled, the safety band and shroud of the cover will be torn making it impossible to repair the cover and replace it on the container without making such repair efforts obvious to an observer. Such attempts to repair would be a clear indication of tampering whereas a lack of damage to the cover would be a clear indication that the container has not been tampered with.

It will also be appreciated that by making the safety band of a different color or with different visually observable indicia than the remainder of the cover, any attempts to remove the safety band and then replace the cover will be easily observable to the consumer since the different colored safety band will be missing.

The cover of the present invention has the advantage that it may be used over existing caps on any existing container shapes, such as bottles or tubes, with little modification to the container. Hence, the present invention provides a safety cover which is independent of the container shape or size and as such can be easily adapted to existing containers of any shape or size to make previously non-tamper proof bottles, tamper resistant. As such, the present covers can be retrofitted on safety cap bottles to maintain the container as childproof or non-childproof covers for persons such as the elderly who may have experienced difficulty with childproof covers.

SUMMARY OF THE INVENTION

The present invention comprises a tamper indicating cover for containers closed by a cap where the container has an annular protrusion at a spaced distance below the cap. The cover, in accordance with the invention, includes a shroud portion positioned entirely over the cap in access preventing relationship to the cap. The shroud further has an annular terminus region from which an annular safety band extends. The annular safety band is intregal with the shroud portion and is configured to extend over the annular protrusion of the container. The safety band and hence the cover is affixed by adhesive or other means to the container at the annular protrusion for preventing removal of the cover from the container without tearing the cover.

An alternative embodiment of the present invention utilizes an annular safety band which is a separate element from the shroud but is permanently affixed to the shroud portion at the annular protrusion. The annular safety band is affixed to the shroud portion by using adhesive or heat bonding or any other method which will permanently affix the safety band to the shroud portion. By utilizing heat bonding or other adhesion means, the safety band can be affixed to the cover and also affixed to the container at the annular protrusion for preventing removal of the cover from the container.

A pull tab may extend from the safety band for transversely rupturing and removing the safety band from the annular protrusion on the container when the pull tab is pulled to effect removal of the cover from the container and give access to the container cap. In still another embodiment, the shroud portion of the cover includes at least one tear line extending from the safety band for enabling the shroud to be torn to facilitate loosening of the cover from the container when the pull tab is pulled. The tear line may comprise either a stress line in the cover or may comprise a thread such as a nylon thread embedded in the cover so that when the thread is pulled, the thread will be pulled through the cover to effect rupturing of the cover.

The safety band of the cover includes indicia different from the shroud portion for identifying the safety band from the shroud portion to indicate to the consumer when the safety band has been removed.

BRIEF DESCRIPTION OF THE DRAWINGS

A complete understanding of the present invention and of the above and other advantages thereof may be gained from a consideration of the following description of the preferred embodiment taken in conjunction with the accompanying drawings in which:

FIG. 1 is a perspective view of the container with a cover in accordance with the invention in position thereon.

FIG. 2 is a cross section of the cover through section 2—2 of FIG. 1.

FIG. 3 is a cross sectional view through section 3—3 of FIG. 1.

FIG. 4 is a cross section of another embodiment of the cover in accordance with the invention.

FIG. 5 is a partial cross sectional view of another embodiment of the cover in accordance with the invention.

DETAILED DESCRIPTION

Referring initially to FIG. 1, a tamper indicating cover 10 is attached to a container 12 which may contain a liquid such as cough syrup, mouth wash, or the like, drugs in pill or capsule form, or other substances such as hair colorings or tints, substances applied to the hair, scalp or skin, and substances for preparation sprayed into, inserted or dropped into body cavities. The container 12 includes a main body 14 which has a top closure end closed by a cap 16. The container 12 has a neck 17 with a shoulder 19 between the neck 17 and the body 14 with an annular protrusion 18 adjacent to the shoulder 19.

The cover 10 comprises a shroud portion 20 which, when in position on the container 12, extends upward from an annular junction or terminus region 22 just above the annular protrusion 18 of the container 12 to entirely cover the portion of the container above the protrusion 18 including the cap 16. Extending down from the annular junction 22 of the shroud portion 20 but intregal with the shroud portion 20 is a safety band 24.

Referring to FIG. 2 in connection to FIG. 1, the safety band 24 comprises an annular band with an annular concave shape which extends over the annular protrusion 18 where it is fixed to the container 12 to immovably retain the cover 10 on to the container 12. In order to assure that the cover 10 can not be removed from the container 12, the safety band 24 may be suitably fused by heat or an adhesive to the container 12 at the protrusion 18 of the container 12. A pull tab 26 may be provided to extend from the safety band 24. The pull tab 26 is part of the safety band 24 so that when the tab 26 is pulled, the safety band 24 will tear traversely allowing the safety band 24 to be pulled free from the protrusion 18, thereby breaking the attachment between the safety band 24 and the container 12. In accordance with one embodiment, as the pull tab 26 is pulled, the safety band 24 will separate from the shroud portion 20 along the annular junction region 22, thereby permanently separating the safety band 24 from the shroud 20 along at least a portion of the annular junction 22. The shroud portion 20 may also include one or more tear lines 28 along which the shroud portion 20 will tear upon pulling of the pull tab 26 to remove the safety band 24. The tear lines 28 extend from the safety band 24 to enable the shroud portion 20 to be torn when the pull tab 26 is pulled. For example, the tear line 28 can be cut as a helical or spiral into the cover 10 as shown in FIG. 1. The shroud portion 20 can then be torn along the helical tear line 28 to form one or more tear strips 30.

The safety band may be simply a thickend portion of the same material, such as a plastic, from which the shroud 20 is formed. Referring to FIG. 3, the pull tab 26 in such an embodiment may be formed by a cut 32 into a region of the safety band 24 with the portion of the safety band 24 above the cut 32 defining the pull tab 26 and the portion of the safety band 24 below the cut 32 defining a weakened area 34 so that when the pull tab 26 is pulled, the weakened area 34 breaches causing the transverse tearing of the safety band 24. Continued pulling causes the safety band 24 to be separated from the container and pulled away from the protrusion 18, thereby releasing the cover 10 and allowing access to the cap 16.

Referring now to FIG. 4, an alternative tamper indicating cover 36 is shown having a similar shroud portion 38. A safety band 40 is affixed to the shroud portion 38 over the annular protusion 18 in a similar manner as the safety band 24 encases the annular protrusion 18 in FIG. 2. In this alternative embodiment of the invention, the cover 36 has a substantially uniform thickness throughout and is placed over the annular protusion 18. The safety band 40 is heat bonded or adhesively affixed to the surface of the cover 36 so that the band 40 becomes permanently affixed to the cover 36. The safety band 40 and cover 36 form a somewhat unititary portion which performs the same function as the safety band 24 used in the other embodiments. Similarly, this safety band 40 can be cut to form a pull tab and a weakened area which breaches causing the transverse tearing of the safety band 40. Also, tear lines can be placed along the shroud portion 38 to help tear the cover 36 when the safety band 40 is removed.

Referring now to FIG. 5, the safety band 24 may be configured to facilitate tearing in the desired direction by embedding a nylon thread 42 which comprises the tear line 28. In such an embodiment, the safety band 24 is strengthened by the thread 42 and will be pulled without traverse tearing. The thread 42 can also be embedded in the shroud portion 20 in a helical configuration so that further pulling causes the thread 42 to pull from the thinner shroud portion 20 causing the shroud portion 20 to tear along the tear lines 28 into one or more tear strips 30.

In an alternative embodiment, the thread 42 can be embedded in the shroud portion in a helical configuration and extend to be embedded in the safety band 24. An end portion 44 of the thread 42 extends from the safety band 24 and terminates in a balled portion 46 which is adhesively attached by a suitable adhesive 48 to the outside surface of the container 12. The balled portion 46 may be simply made from the thread wound in a ball or may comprise a plastic rubber or other mass which is affixed to the end portion 44 of the thread 42. In such an embodiment, the cover 10 may be removed by pulling the balled portion 46 from the surface of the container 12 by rupturing the adhesive bond 48 and thereafter pulling on the balled portion 46. The thread 42 will then pull free from its embedded position in the safety band 24 or alternatively will pull the safety band 24 away from the annular protrusion 18. The safety band 24 will thereafter be pulled from the shroud region 20 as the balled portion 46 is further pulled.

Because of the above described tearing of both the shroud 20 and the safety band 24 from the shroud 20, it can be seen that the cover 10 will have multiple tears which will be impossible to repair without making such repairs obvious to the purchaser. Thus, the purchaser is alerted to a container which has been tampered with.

In accordance with the invention, the safety band is further provided to have visual printing and markings different from that of the shroud portion 20. Thus, if the safety band is removed, any replacement of the shroud portion 20 after tampering will be obvious to the purchaser since the saftey band having the different visual indicia will be missing. For example, in one embodiment, the indicia in the safety band may be an opaque red color while the shroud portion 20 may be a transparent clear plastic. Thus, removal of the safety band will cause the red band to be removed making any attempt to remove the safety band and then replace the shroud 20 obvious to the purchaser because the red indicia band will be missing.

In the various embodiments, the tear lines 28 may simply by weakend portions of the shroud such as grooves as illustrated in FIG. 2. Thus, when the safety band 24 is pulled, the shroud portion 20 will be pulled along the tear lines 28 to effectively release the cover from the container 12 and allow access to the cap 16. Any attempt by a person other than the purchasing consumer to remove the cover 10 and tamper with the contents of the container 12 will permanently destroy the cover 10, thus making tampering obvious to the purchaser.

Referring again to FIG. 5, the illustrated embodiment includes a lower annular ridge 49 extending from the safety band 24. The ridge 49 is attached or likewise fused to the container 12 at a location immediately below the protrusion 18. In operation, when the pull tab 26 or balled portion 46 is pulled, the safety band tears lengthwise leaving the annular ridge 49 attached to the container 12 while the portion of the safety band 24 extending over the protrusion 18 is pulled free from the protrusion 18 to effect removal of the shroud portion 20 of the cover 10. In order to facilitate a separation of the safety band from the annular ridge 48, an annular groove 50 may be impressed between the annular ridge 49 and the safety band 24 thereby weakening the connection between the annular ridge 49 and the safety band 24 to make the required tearing easier. The fact that the annular ridge 49 remains with the container 12 will alert consumers that the cover 10 has been removed.

While the above description has been made with reference to specific embodiments of the invention, it will be appreciated that various modifications can be made without departing from the true spirit of the invention. For example, the cover of the present invention could be placed over any type container including, for example, tubular shaped containers. It is therefore the object of the following claims to cover all such modifications and variations as fall within the true spirit and scope of the invention.

What is claimed is:

1. A tamper indicating cover for a container having a neck, a shoulder at a spaced location below the neck, and a generally cylindrical body adjacent to and extending from the shoulder away from the neck, the cylindrical body having a region adjacent the shoulder which is groove free, the container closed by a cap and having an annular protrusion extending radially outwardly from the groove free region of the body adjacent to the shoulder, the cover comprising:

a tearable shroud portion positioned over the cap in access preventing relationship thereto and having an annular junction region;

an annular safety band integral with the shroud portion and extending from the annular junction region of the shroud, the band extending over the annular protrusion of the body for sealing the cover to the container thereby enclosing the cap; and a pull tab extending from the safety band for being pulled to tear the safety band relative to the shroud to effect removal of the cover from the container and removal of the safety band from the annular protrusion to expose the annular protrusion to observation and give access to the container cap.

2. The cover of claim 1 wherein the shroud is dome shaped.

3. The cover of claim 1 wherein the shroud has at least one tear line extending from the safety band for enabling the shroud to be torn when the pull tab is pulled.

4. The cover of claim 3 wherein the tear line is helical.

5. The cover of claim 3 wherein the tear line comprises a thread embedded in the shroud and safety band for being pulled through the cover when the pull-tab is pulled to effect tearing of the cover.

6. The cover of claim 5 wherein the thread has an end portion which extends out from the safety band, the end portion being removably affixed to the container below the safety band.

7. The cover of claim 3 further comprising an annular ridge intregally formed with and extending from the edge of the safety band remote from the shroud portion, the ridge affixed to the container immediately below the annular protrusion whereby the ridge remains attached to the container and separated from the safety band when the pull tab is pulled and the cover removed.

8. The cover of claim 1 further comprising an annular ridge intregally formed with and extend1ng from the edge of the safety band remote from the shroud portion, the ridge affixed to the container immediately below the annular protrusion whereby the ridge remains attached to the container and separated from the safety band when the pull-tab is pulled and the cover removed.

9. The cover of claim 8 wherein the safety band includes means for visually distinguishing the safety band from the shroud portion.

10. The cover of claim 8 wherein the junction between the safety band and the annular ridge has an annular groove to facilitate separation of the safety from the ridge when the pull tab is pulled.

11. The cover of claim 1 wherein the safety band includes means for visually distinguishing the safety band from the shroud portion.

12. A tamper indicating cover for a container having a neck, shoulder at a spaced location below the neck, and a generally cylindrical body adjacent to and extending from the shoulder away from the neck, the cylindrical body having a region adjacent the shoulder which is groove free, the container closed by a cap and having an annular protrusion extending radially outwardly from the groove free region of the body adjacent to the shoulder, the cover comprising:

a tearable shroud portion positioned over the cap in access preventing relationship thereto and having an annular junction region;

an annular safety band affixed to the shroud portion and extending over the annular protrusion of the body for sealing the cover to the container thereby enclosing the cap; and a pull tab extending from the safety band for being pulled to tear the safety band relative to the shroud portion to effect removal of the cover from the container and removal of the safety band from the annular protrusion to expose the annular protrusion to observation and give access to the container cap.

13. The cover of claim 12 wherein the shroud has at least one tear line extending from the safety band for enabling the shroud to be torn when the pull tab is pulled.

14. The cover of claim 13 wherein the tear line comprises a thread embedded in the shroud and safety band for being pulled through the cover when the pull tab is pulled to effect tearing of the cover.

15. The cover of claim 14 wherein the thread has an end portion which extends out from the safety band, the end portion being removably affixed to the container below the safety band.

16. The cover of claim 14 further comprising an annular ridge intregally formed with and extending from the edge of the safety band remote from the shroud portion, the ridge affixed to the container immediately below the annular protrusion whereby the ridge remains attached to the container and separated from the safety band when the pull tab is pulled and the cover removed.

17. The cover of claim 13 wherein the safety band includes means for visually distinguishing the safety band from the shroud portion.

18. The cover of claim 12 wherein the shroud is dome shaped.

19. The cover of claim 12 further comprising an annular ridge intregally formed with and extending from the edge of the safety band remote from the shroud portion, the ridge affixed to the container immediately below the annular protrusion whereby the ridge remains attached to the container and separated from the safety band when the pull tab is pulled and the cover is removed.

20. The cover of claim 12 wherein the safety band includes means for visually distinguishing the safety band from the shroud portion.

* * * * *